United States Patent [19]

Law et al.

[11] Patent Number: 4,877,005

[45] Date of Patent: Oct. 31, 1989

[54] FUEL INJECTION PUMPING APPARATUS

[75] Inventors: David J. C. Law, London; Lukhbir S. Panesar, Feltham, both of Great Britain

[73] Assignee: Lucas Industries Public Limited Company, Birmingham, England

[21] Appl. No.: 326,155

[22] Filed: Mar. 20, 1989

[30] Foreign Application Priority Data

Mar. 25, 1988 [GB] United Kingdom ..... 8807137

[51] Int. Cl.[4] ..... F02M 38/00

[52] U.S. Cl. ..... 123/458; 123/494

[58] Field of Search ..... 123/458, 494, 450, 459, 123/460, 357, 358, 359; 417/462

[56] References Cited

U.S. PATENT DOCUMENTS

| | | | |
|---|---|---|---|
| 2,571,571 | 10/1951 | Hanners | 123/370 |
| 4,351,283 | 9/1982 | Ament | 123/458 |
| 4,446,836 | 5/1984 | Mowdray | 123/458 |
| 4,528,580 | 9/1985 | Stradel | 123/458 |
| 4,561,405 | 12/1985 | Simons | 123/494 |
| 4,601,274 | 7/1986 | Seilly | 123/458 |
| 4,664,079 | 5/1987 | Sarkuranaka | 123/370 |
| 4,708,111 | 11/1987 | Shiozaki | 123/494 |
| 4,757,791 | 7/1988 | Hachitani | 123/494 |
| 4,793,311 | 12/1988 | Salzegeber | 123/450 |

*Primary Examiner*—Carl Stuart Miller

*Attorney, Agent, or Firm*—Balogh, Osann, Kramer, Dvorak, Genova & Traub

[57] ABSTRACT

A fuel injection pumping apparatus for supplying fuel to an engine includes a high pressure pump which receives fuel from a low pressure pump by way of an angularly adjustable throttle member. The throttle member is connected to the armature of an electromagnetic actuator by means of a connecting rod. A transducer is provided which includes a core carried by the connecting rod intermediate the ends thereof and a pair of springs act to oppose the movement of the rod and throttle member by the actuator.

6 Claims, 4 Drawing Sheets

FUEL INJECTION PUMPING APPARATUS

This invention relates to a fuel injection pumping apparatus for supplying fuel to an internal combustion engine comprising a high pressure pump to which fuel is supplied through an angularly adjustable throttle member from a low pressure pump, an electromagnetic actuator for varying the setting of the throttle member in response to a control signal supplied by an electronic control system and a transducer for supplying a signal to the control system indicative of the position of the throttle member.

With such an apparatus it is necessary to ensure that even if the connection between the actuator and the metering valve is broken the transducer will continue to supply a signal to the control system indicative of the setting of the throttle member and also that the throttle member should move to a minimum fuel position.

The object of the invention is provide an apparatus of the kind set forth in a simple and convenient form.

According to the invention a fuel injection pumping apparatus for supplying fuel to an internal combustion engine comprises a high pressure fuel pump to which fuel is supplied through an angularly adjustable throttle member from a low pressure pump, an axially movable connecting rod, one end of said rod being coupled to said throttle member by means of a link which is pivotally coupled to said one end of the rod and to an arm integral with the metering valve, an electromagnetic actuator for moving the rod in response to a control signal supplied by an electronic control system, the actuator moving the throttle member in a direction to increase the amount of fuel supplied to the high pressure pump, said electromagnetic actuator including an armature which is connected to the other end of the rod, a transducer for providing a signal to said control system indicative of the setting of said throttle member, said transducer including a core which is carried by said rod intermediate the ends thereof, a first spring acting between said one end of the rod and a fixed part to oppose movement of the rod and throttle member by the actuator and a second spring acting to assist the action of the first spring said second spring acting on said rod adjacent the other end thereof.

In the accompanying drawings

Figure 1:
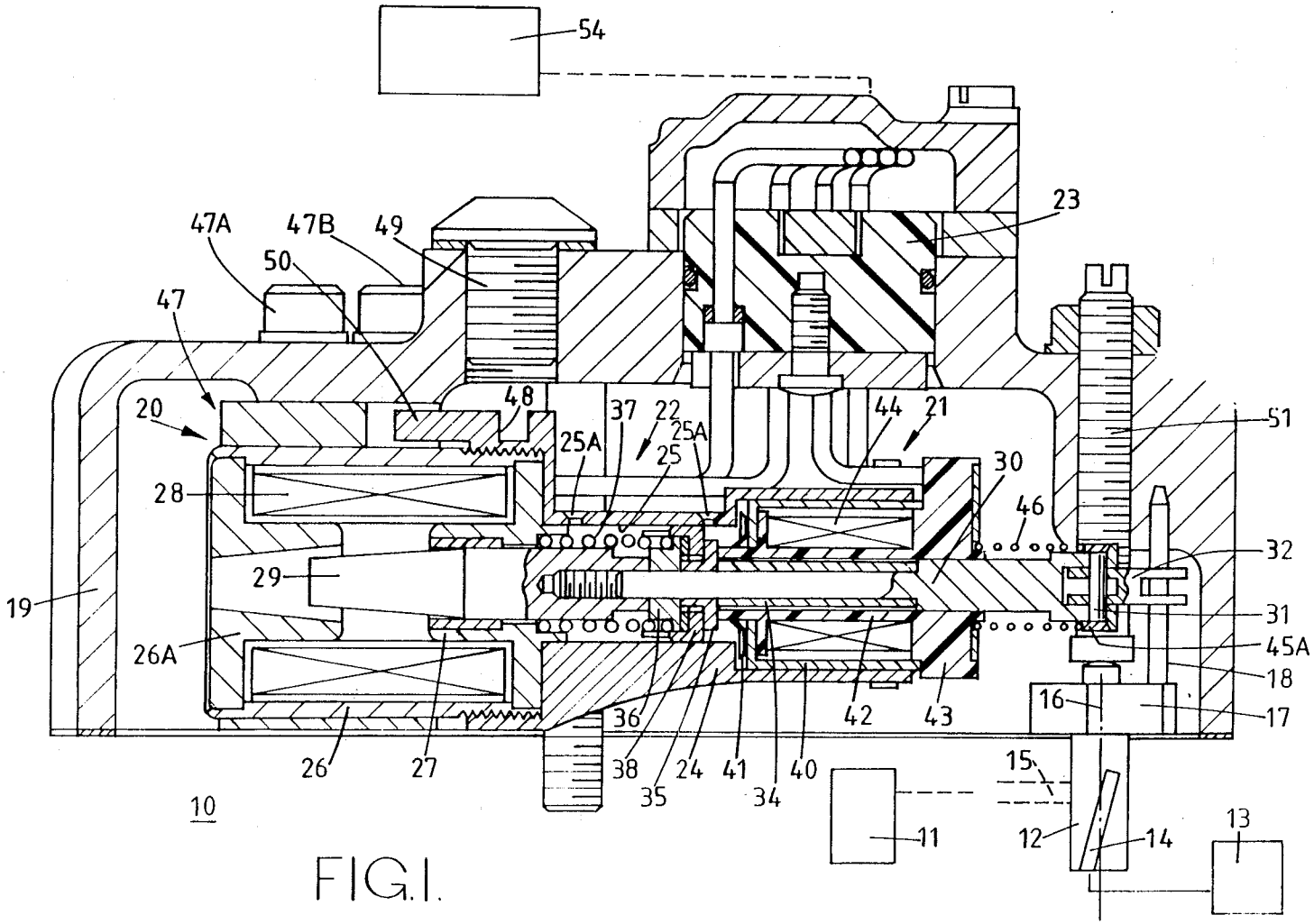
FIG. 1 is a sectional side elevation of a part of a fuel pumping apparatus in accordance with the invention.
Figure 2:
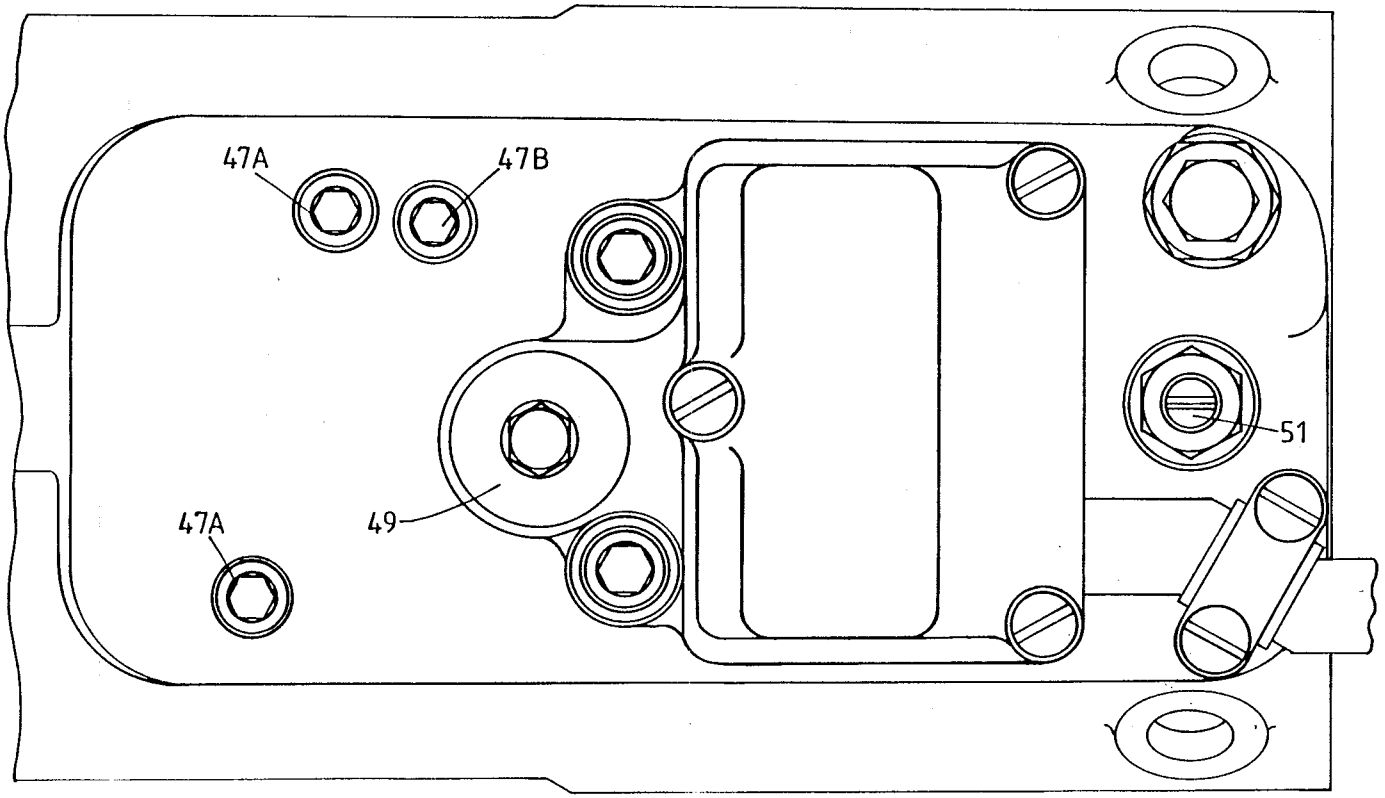
FIG. 2 is a plan view of the part of the apparatus seen in FIG. 1.

With reference to the drawings the apparatus includes a body 10 which houses a rotary distributor type fuel injection pumping apparatus. The apparatus is of a well known type and the control of the supply of fuel to the high pressure pump 11 is by means of an angularly adjustable throttle member 12, the fuel under pressure being supplied by a low pressure pump 13. The throttle member is of cylindrical form and is located within a bore in the body 10, the inner end of the bore being connected to the outlet of the low pressure pump the outlet pressure of which is controlled by a valve in known manner, so that it varies in accordance with the speed of the associated engine. The throttle member has an axial groove 14 formed in its peripheral surface and the groove receives fuel from the outlet of the low pressure pump. For registration with the groove a port 15 is formed in the body 10, the port being connected to the inlet of the high pressure pump. The groove 14 is, as shown in FIG. 1, inclined slightly to the axis of the throttle member, the axis being shown at 16 in FIG. 1. Mounted on the throttle member is an arm 17 and adjacent the end of the arm is an upstanding pin 18.

The arm 17 and the pin 18 lie on the exterior of the body 10 within a hollow generally rectangular housing 19 which is secured to the body. The housing serves to house an electromagnetic actuator 20, a transducer 21 and a damping device 22. Moreover, the upper wall of the housing accommodates an electrically insulating cable location block 23 by which connections are effected to an electronic control system 54.

The actuator, damping device and the transducer are constructed as a unit which is secured on the housing and the unit comprises a support 24 which at one end is machined or formed to hollow cup shape form to receive the stator of the actuator and at its other end is formed or machined to cup shape form to receive the stator of the transducer. Intermediate its ends the support defines a bore 25 and opening into the bore are a pair of axially spaced drillings 25A. The support 24 is formed from non-magnetic material such as aluminium and the inner peripheral surface of the skirt at said one end of the support is screw threaded to receive the complementarily threaded end portion of a tubular yoke 26 formed from magnetic material. Te yoke is spun about a magnetic core member 26A within which is defined a tapering bore. A further magnetic core member 27 is provided with a cylindrical bore and also with a peripheral flange and is held in position against a base wall defined by the support 24 by the yoke 26. Surrounding the core members and lying within the yoke 26 is an annular winding 28. Moreover, supported in the bore in the the core member 27 is a bearing sleeve formed from non-magnetic material. The sleeve supports an armature 29 for axial movement, the armature having a tapered portion which can enter into the tapered bore in the core member 26A. The armature and core members are designed as a proportional solenoid.

In the end of the armature opposite to the tapered portion thereof there is formed a threaded drilling in which is secured the threaded end of a stepped non-magnetic connecting rod 30 the other end portion of which is provided with a transverse slot. A pin 31 extends across the slot and through the forked end portion of a link 32 the opposite end portion of which is also forked, the forks being provided with apertures through which can extend the pin 18. The two pins are engaged by the ends of a wire spring 33 which acts to take up any backlash between the pins and the apertures in the forks of the links.

Located about the rod is a tubular soft iron core 34, a flanged locating piece 35 and a spring abutment 36, the latter engaging the armature 29 and the core 34 engaging a step defined on the rod. The core 34, the piece 35 and the abutment 36 are held in end to end engagement when the rod is screwed into the drilling in the armature. A coiled compression spring 37 is positioned between the abutment 36 and the core member 27 and an apertured cup-shaped damper piston 38 is located between the spring abutment 36 and the flange of the locating piece 35.

The skirt of the damper piston 38 is a sliding fit within the wall of the bore 25 and the piston together with the wall of the bore and the drillings 25A form a damper with the damping fluid being fuel, which is contained within the housing. The aperture in the base wall of the piston 38 is slightly larger than the locating piece so that the piston can move transversely relative to the locating piece to avoid any problems due to misalignment. The piston is located against axial movement relative to the spring abutment by means of a shim interposed between the piston 38 and the abutment 36 or by means of a light spring. However, if desired the base wall of the piston can be formed to the correct thickness.

Figure 3:
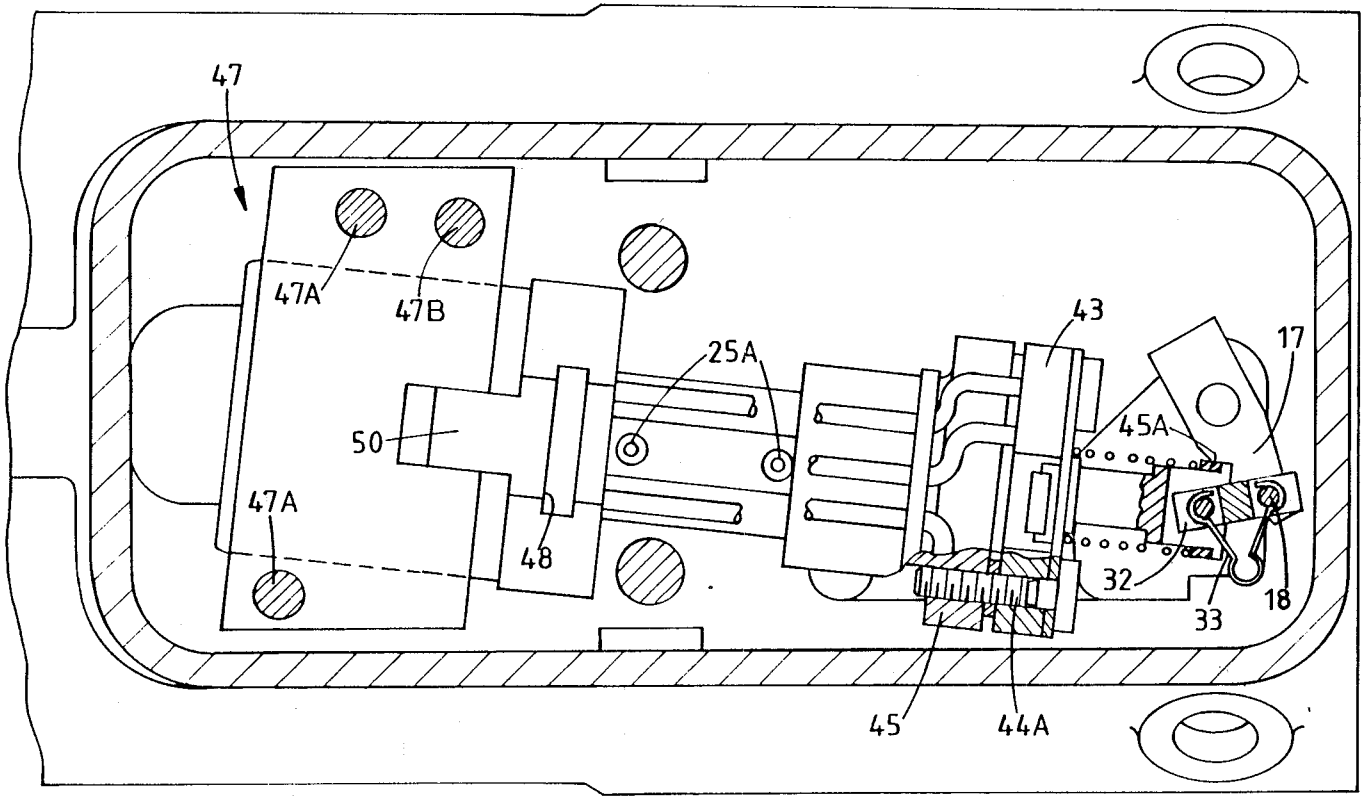
FIG. 3 is a view similar to FIG. 2 with part of a cover removed.

The transducer 21 includes a stator 40 formed from magnetic material which is of hollow cylindrical form having an inwardly directed flange at one end. The stator 40 is positioned within the cup-shaped end of the support 24 and within the stator is a tubular former 42 at one end of which is a boss 43 the former and boss being formed from an electrically insulating and non-magnetic material. The stator 40 is retained on the tubular former by means of a spring fastener 41 with the flange of the stator being held against a flange of the former. As seen in FIG. 3 the boss 43 is secured by means of screws 44A to a pair of ears 45 defined by the support 24. As shown a shim is provided between the ears and the boss for the purpose of adjustment of the position of the boss and the associated components, relative to the support. A winding 44 is wound about the former. The boss 43 defines a bearing for the rod and interposed between the oss and a sleeve 45A which surrounds the rod, is a further coiled compression spring 46. The sleeve 45A bears against a step defined adjacent the end of the rod and helps acts to locate and retain the pin 31. Although a single winding 40 is shown it is in fact composed of a number of series connected axially spaced coils which are located in slots defined by the former.

As described the core 34 is subjected to the clamping force which is developed when the rod 30 is screwed into the armature 29. This can upset the magnetic properties of the core and as an alternative the rod can be surrounded by a stainless steel sleeve which is located between the step and the locating piece 35 and is subjected to the clamping force. The core surrounds the sleeve and is fractionally shorter than the sleeve. It can be secured in position for example by a suitable adhesive. Alternatively a further step can be defined as the rod which is engaged by the locating piece.

The unit formed by the support 24 and the components associated therewith is clamped relative to the upper wall of the housing 19 using a split clamp 47 which locates about the yoke 26. The clamp is secured to the housing by screws 47A and a clamping screw 47B can be slackened to permit axial adjustment of the support 24 within the housing, the adjustment being facilitated by the provision of a slot 48 which is accessible through an access hole in the housing and which is closed by a plug 49or by a connector body. The support 24 defines a tongue 50 which locates in a slot in a part of the clamp to prevent angular movement of the support during the adjustment process When the winding 28 is de-energised the parts assume the position shown in the drawings with the flange of the locating piece 35 in engagement with the end of the tubular former 42. The axial adjustment of the support 24 will determine the setting of the throttle member 12 and once this has been set, the clamp can be tightened. It is convenient to set the support 24 by first passing a current through the winding 28 thereby moving the armature until a predetermined transducer output is obtained, the support is then adjusted until the output of the pumping apparatus is within prescribed limits. Fine adjustment is achieved by using a adjustable stop 51 which can be used to determine the axial setting of the throttle member when the pump is running and fuel under pressure is applied to the lower end of the throttle member.

In operation, the control system 54 supplies electric current to the winding 28 of the actuator. The armature and therefore the throttle member will assume a position dependent upon the magnitude of the current. A signal indicative of the actual position of the rod and therefore the throttle member is obtained from the winding 44. Damping of the movement of the armature and the throttle member is provided by the damper and this limits the degree of overshoot or undershoot when the current flow in the winding 28 is varied.

The spring 33 serves to eliminate any backlash between the pins 18 and 31 and the apertures in which they are located and as will be seen from FIG. 3, it is conveniently located within the slotted end portions of the link 32. The spring 33 acts on the centre lines of the rod 30 and the arm 17 thereby to minimise the risk of causing jamming of the connection between the rod and the arm.

Two springs are provided to bias the rod and therefore the throttle member to the minimum fuel position and this provides a safety feature in the event that one of the springs breaks or weakens. It will be noted that the transducer is located intermediate the actuator and the throttle member so that assuming no breakage of the connection between the transducer and the throttle member, the transducer will always provide a signal indicative of the position of the throttle member. In the event therefore that the rod 30 becomes unscrewed from the armature 29, the transducer will still continue to give a signal indicative of the actual position of the throttle member. If for example, the rod 30 breaks adjacent the forked end thereof, the spring 46 will move the throttle member to the minimum or zero fuel position. The transducer will however continue to provide a signal indicating a higher fuelling position, which is a safe condition.

If the control system is provided with stored information regarding the expected position of the throttle for a given current flow in the winding 28 then if there is an appreciable difference in the actual position of the throttle for a given current, such as would be the case if one or both springs weaken or break or the rod unscrews, the control system can cause engine shut down or at least reduce the current flowing in the winding.

For engine starting purposes the control system can be arranged to set the throttle member at the desired position. However, in cold conditions the voltage of the battery which powers the system can fall to a value which is less than that required for operation of the normal processor of the control system. It is therefore preferable to provide a separate start up control section which sets the throttle member and which receives signals from a speed sensor. If the engine speed exceeds a predetermined value before the battery voltage has risen to a value to allow operation of the processor, the throttle member will be closed and an ON/OFF valve operated to prevent further flow of fuel to the engine.

Figure 4:
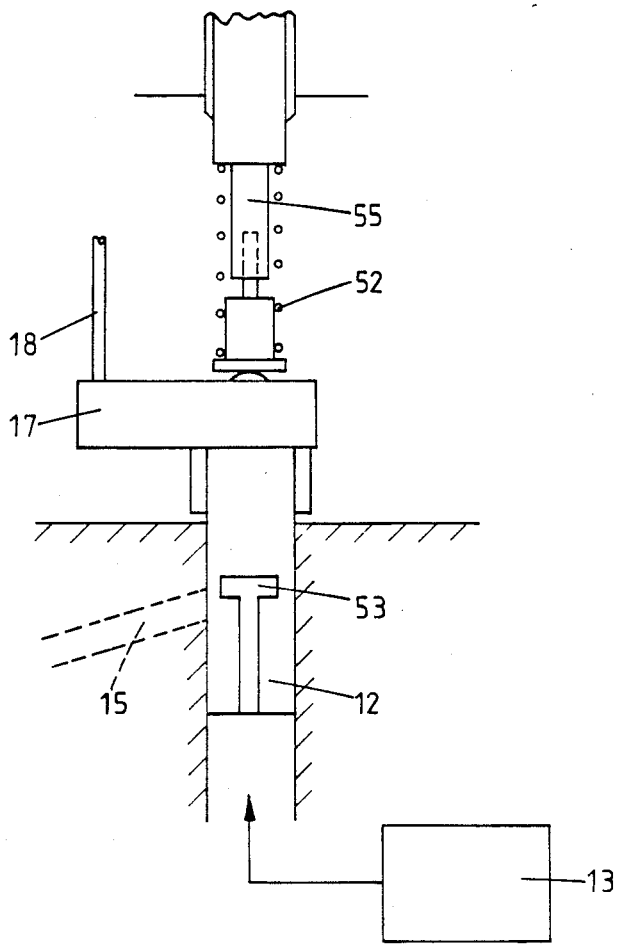
FIG. 4 shows an axially movable throttle.

Alternatively as shown in FIG. 4, a "mechanical" approach is possible and in this case the throttle member 12 is movable axially downwardly by a light spring 52 to an engine start position. The underside of the throttle member is exposed to the output pressure of the pump 13 and a drilling or groove 53 is provided on the throttle member which at rest communicates with the port 15 to allow fuel flow to the high pressure pump in sufficient quantity to allow starting of the engine. Once the engine starts the output pressure of the pump 13 acting on the underside of the valve member will urge the throttle member upwardly until a spring abutment engages a stop 55, to reduce the fuel supply to the engine and the throttle member will act as an hydraulic governor to control the engine speed to a value below its normal idling speed. Once the engine has started the control of the angular setting of the throttle member 12 is taken over by the control system. When the spring abutment is in contact with the stop 55 the throttle member is said to be in the engine run position. As with the electronic starting control an engine shut off valve is incorporated into the design of the apparatus and in this case it forms the sole means of stopping the associated engine so that its operation is checked each time the engine is stopped.

It can be arranged that the groove or drilling 53 in the throttle member does not register with the port 15 until the throttle member 12 has been moved angularly by a small amount.

We claim:

1. A fuel injection pumping apparatus for supplying fuel to an internal combustion engine comprising a high pressure fuel pump to which fuel is supplied through an angularly adjustable throttle member from a low pressure pump, an axially movable connecting rod, one end of said rod being coupled to said throttle member by means of a link which is pivotally coupled to said one end of the rod and to an arm integral with the throttle member, an electromagnetic actuator for moving the rod in response to a control signal supplied by an electronic control system, the actuator moving the throttle member in a direction to increase the amount of fuel supplied to the high pressure pump, said electromagnetic actuator including an armature which is connected to the other end of the rod, a transducer for providing a signal to said control system indicative of the setting of said throttle member, said transducer including a core which is caried by said rod intermediate the ends thereof, a first spring acting between said one end of the rod and a fixed part to oppose movement of the rod and throttle member by the actuator and a second spring acting to assist the action of the first spring said second spring acting on said rod adjacent the other end thereof.

2. An apparatus according to claim 1 in which said core is formed from magnetic material and is of tubular form, the core being located about the rod in such manner that there is substantially no mechanical stress applied to the core.

3. An apparatus according to claim 1 including a pin upstanding from said arm and extending parallel to the axis of angular movement of the throttle member and offset relative thereto, said link defining an aperture at one end through which said pin is passed, the one end of the rod being forked and the other end of said link being located between said forks and coupled thereto by a further pin.

4. An apparatus according to claim 3 in which the opposite ends of said link are forked and the portions of the pins between said forks are engaged by the opposite ends of a spring.

5. An apparatus according to claim 3 in which said further pin is located against axial movement by a sleeve which is held in position against a step defined at said one end of the rod by said first spring.

6. An apparatus according to claim 2 including a sleeve formed from non magnetic material mounted about the rod, said core being mounted about said sleeve and the sleeve acting as a spacer between a step on the rod and a locating piece mounted about the rod.

* * * * *